United States Patent [19]

Setzer et al.

[11] Patent Number: 4,976,129

[45] Date of Patent: Dec. 11, 1990

[54] APPARATUS FOR THE AXIAL SHIFTING OF A SHAFT, ESPECIALLY OF A ROLLING-MILL ROLL

[75] Inventors: Helmut Setzer, Siegen; Axel Sprenger, Hilchenbach; Josef Zeppenfeld, Olpe, all of Fed. Rep. of Germany

[73] Assignee: SMS Schloemann-Siemag Aktiengesellschaft, Düsseldorf, Fed. Rep. of Germany

[21] Appl. No.: 203,220

[22] Filed: Jun. 6, 1988

[30] Foreign Application Priority Data

Jun. 4, 1987 [DE] Fed. Rep. of Germany ..... 3718646

[51] Int. Cl.[5] ..... B21B 31/07

[52] U.S. Cl. ..... 72/247; 72/249; 285/18; 285/420; 403/37; 403/360; 464/182; 464/901

[58] Field of Search ..... 285/18, 322, 340, 420; 403/37, 360; 464/182, 901; 72/247, 249

[56] References Cited

U.S. PATENT DOCUMENTS 2,574,773 11/1951 Bannister ..... 403/37

FOREIGN PATENT DOCUMENTS 0125452 4/1984 European Pat. Off. .
2845266 4/1980 Fed. Rep. of Germany .
3145134 5/1983 Fed. Rep. of Germany .
8222144 1/1984 Fed. Rep. of Germany .

*Primary Examiner*—W. Donald Bray
*Attorney, Agent, or Firm*—Herbert Dubno; Andrew M. Wilford

[57] ABSTRACT

The apparatus transmits a high shifting force reliably and has a simple and rapid assembly. The axial shifting occurs by a clamping device which is in releasable working connection with the roll stub shaft of a rolling-mill roll or the rotating shaft. The disengageable clamping junction is formed between the clamping device and roll stub shaft shaped to fit together. Especially the clamping device is formed as a compact unit comprising a clamping head with at least one axially precompressed compressible spring which acts on a plurality of clamping disks working as a clamping body. The clamping disks force a radially elastic clamping sleeve to grip the roll stub shaft. The clamping disks are releasable from a clamped position by a hydraulic pressurized medium against the action of the compressible spring. The clamping disks are supported axially on the one side on a portion of a housing of the clamping head and on the other side by an axially slidable hollow cylinder acted on by the compressible spring. The clamping sleeve is provided internally in the vicinity of the clamping disks acting on it with a shape which forms the disengageable clamping junction together with a complementary shape on the roll stub shaft.

6 Claims, 4 Drawing Sheets

APPARATUS FOR THE AXIAL SHIFTING OF A SHAFT, ESPECIALLY OF A ROLLING-MILL ROLL

THE FIELD OF THE INVENTION

Our present invention relates to an apparatus for the axial shifting of a rotating shaft, especially of a rolling-mill roll.

BACKGROUND OF THE INVENTION

Up to now the axial shifting of the working and intermediate rolls of a rolling mill has been performed by a variety of coupling methods which are all very expensive since a different apparatus was required for each roll size. The known apparatuses can only be used in connection with a comparatively large roll stub shaft diameter.

An annular-gripping safety clamping unit is described in German Open patent application Ser. No. 28 45 266 for various applications, but not for rolling-mill rolls. Also structurally required sliding forces only up to 20 tons can be transmitted by force-locking units of this type.

OBJECTS OF THE INVENTION

It is an object of our invention to provide an apparatus for axially shifting a rotating shaft, especially of a rolling-mill roll, by which the above mentioned disadvantages can be avoided and/or the difficulties can be removed.

It is also an object of our invention to provide an apparatus for axially shifting a rotating shaft, especially of a rolling-mill roll, with which a large axial force can be safely transmitted.

It is another object of our invention to provide an apparatus for axially shifting a rotating shaft, especially of a rolling-mill roll, which can be assembled quickly and easily to the roll stub shaft.

SUMMARY OF THE INVENTION

These objects and others which will become more readily apparent hereinafter are attained in accordance with our invention in an apparatus for axially shifting a rotating shaft, especially of a rolling-mill roll.

According to our invention the axial shifting is effected by a clamping device which is in releasable working connection with the roll stub shaft or neck of the rolling-mill roll.

The clamping device according to our invention may be used for shifting a working roll, an intermediate roll or a supporting roll or any combination thereof in a mill stand. It is especially applicable to a rolling mill with so-called bottle rolls which must be shifted relative to one another to change the roll gap shape and in which a simple release and engagement of the coupling between roll stub shaft and clamp can be effected.

The coupling system is indeed usable for all manner of axial sliding motions of a roll in a rolling mill, but particularly for a roll which is not driven. Furthermore the coupling can be used with a driven roll in which the shaft or pin for the axial bearing is formed as a hollow shaft. The drive moments are thus transmitted to the roll by the hollow shaft shaped to fit together with it and the axial forces are transmitted by the roll coupling according to our invention.

Advantageously the disengageable clamping junction is formed between the clamping device and the roll stub shaft which are shaped to fit together. In this way a large sliding force, e.g. up to 50 metric tons, may be transmitted as desired by the form-fitting connection. Our apparatus further allows the use of a smaller roll stub shaft diameter.

Advantageously the clamping device is formed as a compact unit comprising a clamping head with at least one axially precompressed compressible spring which acts on a plurality of clamping disks acting as a clamping body.

A radially elastic clamping sleeve, preferably formed from a multiplicity of axially extending fingers, is compressed by the clamping disks when the latter are twisted to grip the roll stub shaft. The clamping disks are releasable from their clamped position by the action of a pressurized hydraulic fluid against the action of the compressible spring. The clamping disks are engaged on the one side axially by a portion of a housing of the clamping head and on the other side by an axially slidable hollow cylinder acted on by the compressible spring.

The clamping sleeve is provided internally in the vicinity of the clamping disks acting on it with a shape which forms the disengageable clamping junction together with a complementary shape on the roll stub shaft. With this structure a reduced structural length, in part because of a shortened roll stub shaft is possible, whereby the roll-changing carriage can be made shorter. The coupling unit can be changed reliably and quickly. Especially advantageously the roll stub shaft members in the vicinity of the coupling system are replaceable. Reduced manufacturing costs thus result.

According to another feature of our invention the clamping device is coupled to an axial bearing unit. The clamping device has a clamping head shaft attached rigidly to the clamping head which is surrounded by at least one axial bearing located in an axial bearing housing.

The axial sliding forces for the roll are transmittable by the axial bearing housing to the clamping head shaft, the clamping head and/or finally by the sides of the channels of the clamping sleeve to the roll stub shaft of the roll. The roll stub shaft can thus be made shorter. The clamping head shaft of the clamping unit essentially forms an extension of the roll stub shaft. Thus cost savings result since the clamping head shaft must be present only once and is usable for different rolls.

Alternatively to the above arrangement for the axial bearing unit it is appropriate and advantageous when an axial bearing is positioned between the clamping device and the roll bearing. The roll coupling can be located then behind the axial bearing, of course with a disadvantage: a longer roll. The shorter feed path of the bending block is advantageous.

Advantageously the complementary shapes on the rotating shaft or roll stub shaft and the clamping sleeve are provided by a plurality of annular grooves or channels.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
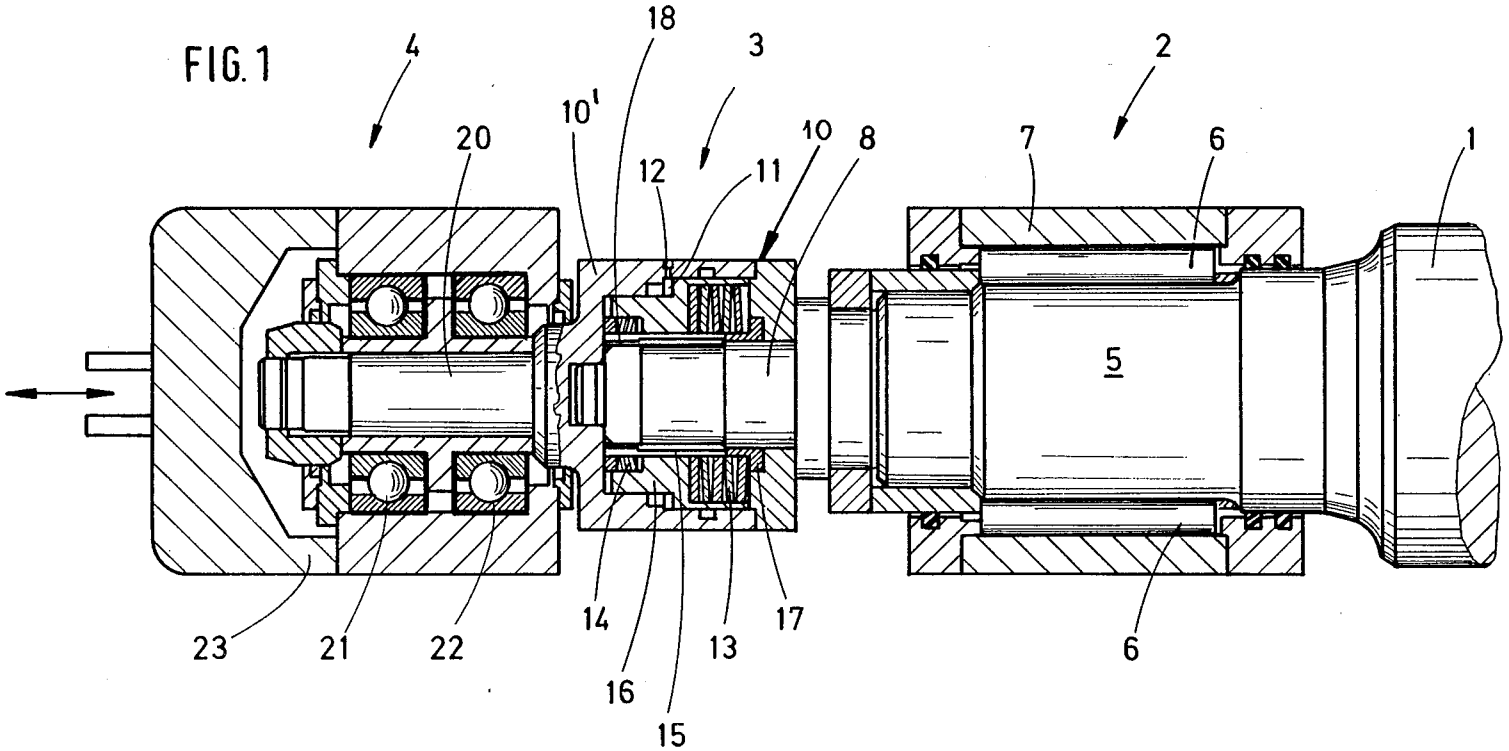
FIG. 1 is an axial sectional view of a clamping device according to our invention.

FIG. 1 shows the structure of a rolling mill roll 1 with thrust or roll bearing 2, a clamping device 3 and an axial bearing unit 4.

The roll 1 thus has a bearing shaft 5 which is supported in a radial bearing 6 of the structural member 7 in the thrust or roll bearing 2. The bearing shaft 5 has a rigidly or detachably connected roll shaft or stub shaft 8 at its outer end which is surrounded by the clamping device 3 according to our invention.

The clamping device 3 comprises a clamping head 10, i.e. a housing 10' with a pressure medium chamber 11 and a connector 12 for a hydraulic pressure medium and further at least one axially compressed compressible spring 13 which acts on the clamping body 14 surrounding the stub shaft 8.

Figure 2:
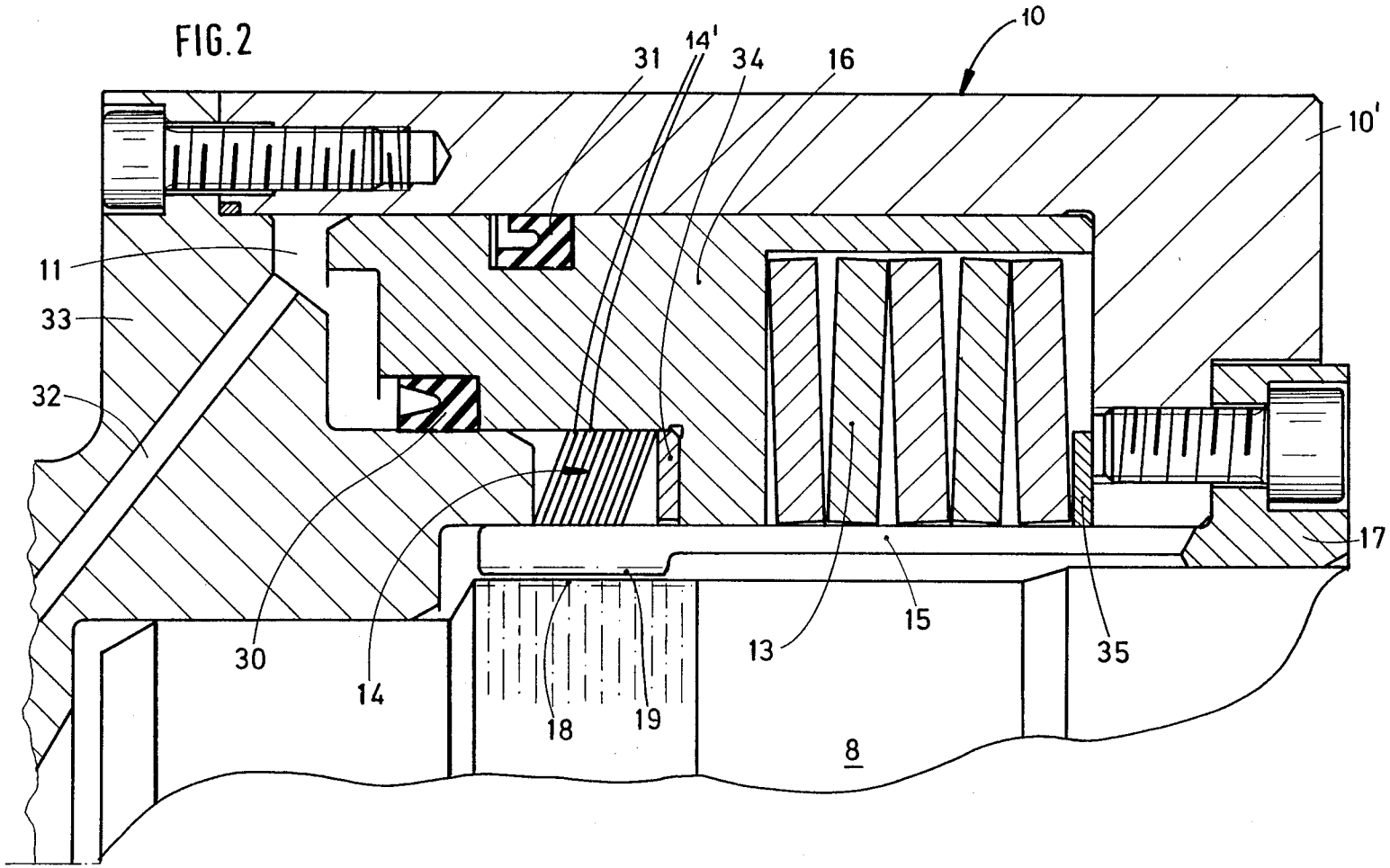
FIG. 2 is a sectional view of a portion of a slightly different embodiment of the clamping device according to our invention, drawn to a larger scale than that of FIG. 1 but generally similar to that of FIG. 1.

As seen in FIG. 2 the clamping body 14 comprises a plurality of clamping disks 14' which, upon being twisted toward a planar state, force a radially elastic clamping sleeve 15 to grip the roll stub shaft 8.

The clamping disks 14' are braced on one side on the clamping head 10 and on the other side are clamped by an axially slidable hollow cylinder 16 acted on by the spring 13.

The clamping sleeve 15 has a circular flange 17 on one end which is releasably engaged with the clamping head 10. The clamping sleeve 15 is provided internally with a shape in the vicinity of the clamping disks 14' acting on it which is in releasable working connection with a complementary shape on the roll stub shaft (see FIG. 3) in a form-fitting manner. The clamping junction is disengaged when the clamping disks 14' and thus the clamping sleeve 15 are released from their clamping positions by a the piston 16 when the compartment 11 of this piston 16 is pressurized with hydraulic fluid and moved backward operating against the action of the compressible spring 13.

The clamping device 3 has a clamping head shaft 20 attached rigidly to the clamping head 10 and/or the housing 10', which is received by the axial bearing unit 4 and advantageously by two axial bearings 21, 22.

The axial sliding force of the roll 1 is then transmitted by the axial bearing housing 23 to the clamping head shaft 20, the clamping head 10 and/or finally by the sides of the profiled annular grooves 40, 41 (FIG. 3) between the clamping sleeve 15 and the roll stub shaft 8 of the roll 1.

FIG. 2 shows a clamping head 10 according to our invention similar to FIG. 1 in cross section. However, it is drawn to a larger scale and has somewhat different structural details (parts working in the same way have the same reference number).

The clamping head 10 surrounds the compressible medium chamber 11 which is sealed by U and V annular seals 30, 31 against the axially moving hollow cylinder 16.

The compressible medium is fed to the compressible medium chamber 11 through the duct 32. The duct 32 in this embodiment is located in the cover 33 of the clamping head 10.

The axially precompressed spring 13 is positioned between the clamping head 10 and the hollow cylinder 16 and comprises a cup spring which acts on the clamping body, i.e. the clamping disks 14', surrounding the roll stub shaft 8 and clamps the longitudinally slotted clamping sleeve 15 against the roll stub shaft 8.

The clamping sleeve 15 has a circular flange 17 on one end which is rigidly attached by screws on the clamping head 10. The clamping disks 14' are (as described in FIG. 1) displaced from their clamped position by a pressurized hydraulic fluid against the action of the compressible spring 13. The clamping disks 14' are braced on the cover 33 of the clamping head 10 and are clamped by the axially slidable hollow cylinder 16 and/or by a hard disk 34 positioned between them by the spring 13 which is braced by the hardened disk 35 in the clamping head 10.

Thus when the compartment 11 is pressurized the piston 16 is shafted back (to the right in FIG. 2), thereby compressing the washers 13 and allowing the washers 14' to resume their dished shape. When the washers 14' return to this dished shape their inner peripheries move radially outward to allow the sleeve 15 to expand elastically so that the formations 18 and 19 can disengage from each other. When the pressure in the chamber 11 is relieved the washers 13 expand axially, thereby axially compressing the washes 14' and radially compressing the sleeve 15 to again couple the housing 10 to the stub shaft 8.

The clamping sleeve 15 is formed internally with a shape 19 in the vicinity of the clamping disks 14' acting on it which is in releasable working connection with the complementary shape on the roll stub shaft 8.

Figure 3:
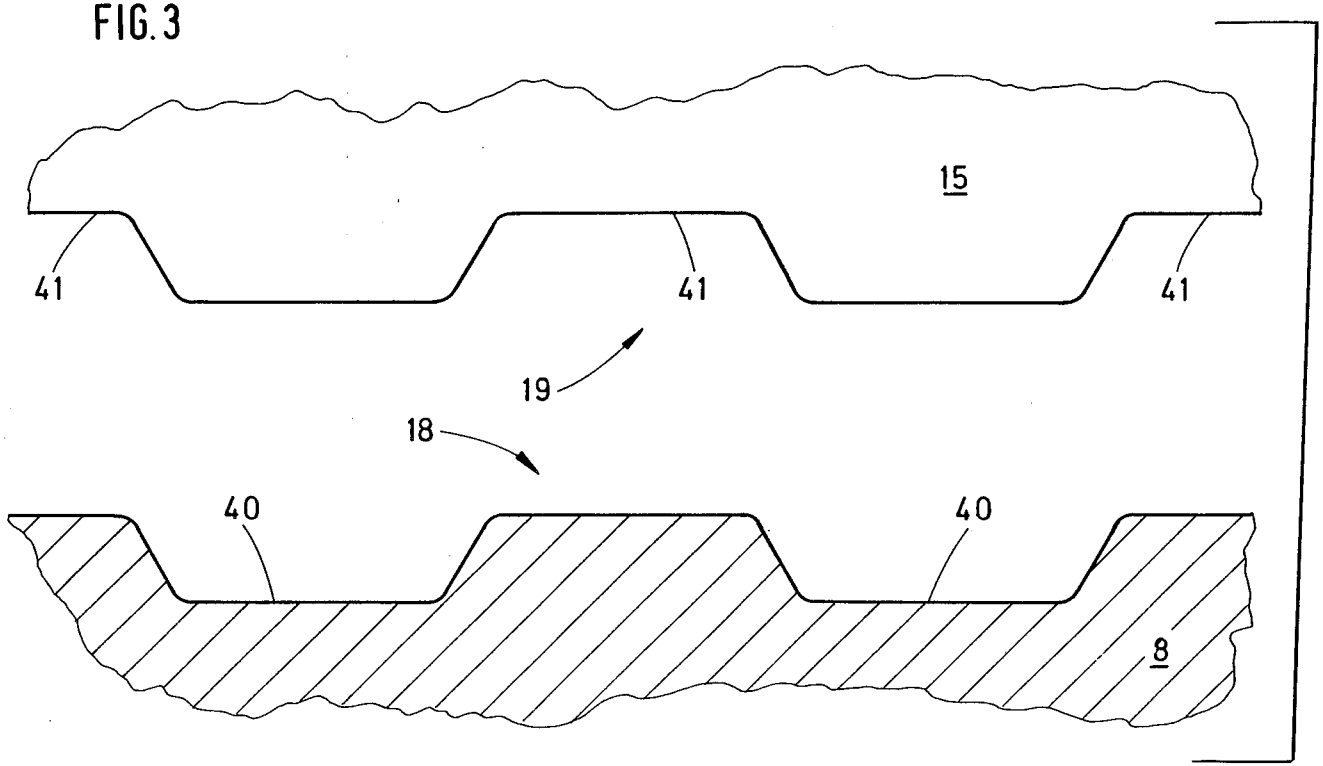
FIG. 3 is a diagrammatic sectional view, partly broken away of the clamping joint between a clamping sleeve and the roll stub shaft or rotating shaft.

FIG. 3 shows in still further enlarged form the complementary shapes 18, 19 of the clamping sleeve 15 and the roll stub shaft 8 in the disengaged position. The shapes 18,19 appropriately comprise numerous substantially parallel annular grooves and/or channels 40, 41 having trapezoidal-shaped cross sections.

Figure 4:
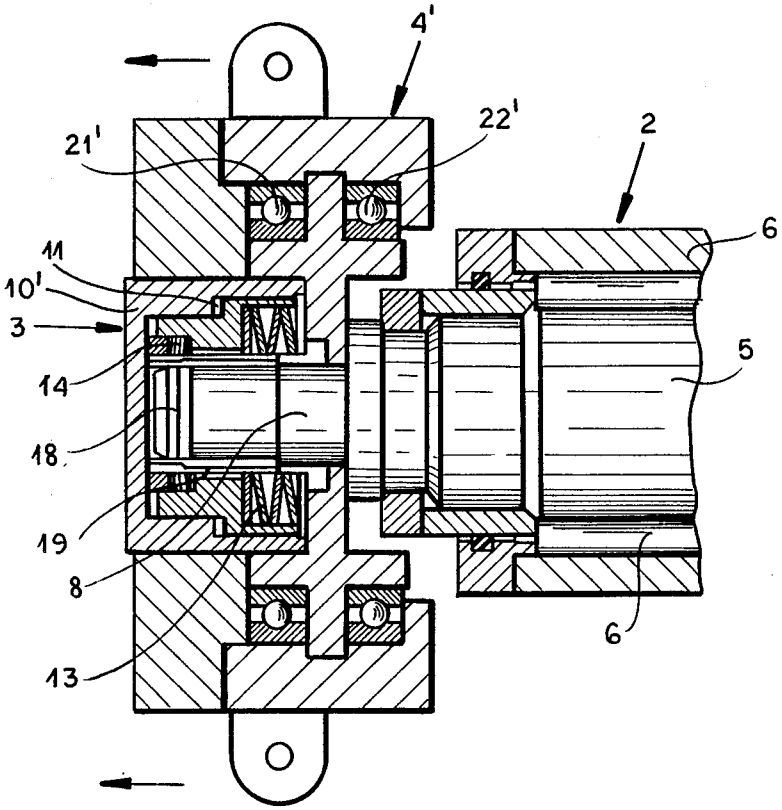
FIG. 4 is a sectional view of another embodiment of a clamping device according to our invention.

FIG. 4 shows an additional embodiment of our invention in which the axial bearing 4' is located between the clamping device 3 and the roll bearing 2. Additional details are similar to previous embodiments. Parts with a similar function have the same reference number. The bearings 21', 22' are here located between the region 18, 19 and the bearing 2.

The features according to our invention are not limited to the example shown in the drawing. Thus for example without leaving the bounds of our invention the opposing clamping surfaces which fit together or the clamping junction can be formed in any of a variety of ways. The specific form for other applications of our apparatus is left to the judgement of one skilled in the art.

We claim:

1. An apparatus for shifting a roll of a rolling-mill stand along its rotation axis, the apparatus comprising:
   - an axial-thrust bearing having a pair of relatively rotatable sides;
   - an actuator connected to one of the sides of the bearing and operable to axially displace the bearing;
   - a clamp housing carried on the other side of the bearing;
   - a radially elastically deformable clamping sleeve axially fixed in the housing and engageable around the stub shaft of the roll to be axially shifted;

generally complementary and radially interfittable formations on the sleeve and on the stub shaft, the sleeve being radially compressible around the stub shaft to engage the formations together and axially couple the stub shaft to the sleeve and therethrough to the clamp housing;

a piston in the clamp housing defining therein a pressurizable compartment, whereby pressurization of the compartment urges the piston axially back in the clamp housing;

at least one axially compressible spring washer engaged axially between the housing and the piston and urging the piston axially forward in the clamp housing; and force-transmitting link means engaged between the piston and the sleeve for compressing the sleeve radially inward on displacement of the piston axially forward.

2. The roll-shifting apparatus of claim 1 wherein the formations are respective sets of interfitting radially open and projecting grooves and ridges.

3. The roll-shifting apparatus defined in claim 1 wherein the force-transmitting link means includes at least one annular clamping disk normally of dished frustoconical shape and having an inner periphery bearing on the sleeve, the disk being axially engaged between the piston and the clamp housing to bear axially backward on the piston and axially forward on the housing, whereby on decompression of the compartment the spring washers shift the piston axially forward to compress and flatten the clamping disk and thereby radially compress the sleeve.

4. The roll-shifting apparatus defined in claim 3 wherein the piston, spring washer, and clamping disk all are centered on the axis.

5. An apparatus for shifting a roll of a rolling-mill stand along its rotation axis, the apparatus comprising:

an axial-thrust bearing having a pair of relatively rotatable sides;

an actuator connected to one of the sides and operable to axially displace the bearing;

a clamp housing carried on the other side of the bearing;

a radially elastically deformable clamping sleeve axially fixed in the housing and engageable around the stub shaft of the roll to be axially shifted;

generally complementary and radially interfittable formations on the sleeve and on the stub shaft, the sleeve being radially compressible around the stub shaft to engage the formations together and axially couple the stub shaft to the sleeve and therethrough to the clamp housing;

a ring piston in the clamp housing defining therein an annular pressurizable compartment, whereby pressurization of the compartment urges the piston axially backward in the clamp housing;

at least one axially compressible spring washer engaged axially between the housing and the piston and urging the piston axially forward in the clamp housing; and at least one annular clamping disk normally of dished frustoconical shape and having an inner periphery bearing on the sleeve, the disk being axially engaged between the piston and the clamp housing to bear axially backward on the piston and axially forward on the housing, the piston, spring washer, and disk all being coaxial, whereby on decompression of the compartment the spring washers shift the piston axially forward to compress and flatten the clamping disk and thereby radially compress the sleeve.

6. An apparatus for axially shifting a shifting a shaft which rotates about an axis and bears substantial loads, the apparatus comprising:

an axial-thrust bearing having a pair of relatively rotatable sides;

an actuator connected to one of the sides of the bearing and operable to axially displace the bearing;

a clamp housing carried on the other side of the bearing;

a radially elastically deformable clamping sleeve axially fixed in the housing and engageable around the shaft of the roll to be axially shifted;

generally complementary and radially interfittable formations on the sleeve and on the shaft, the sleeve being radially compressible around the shaft to engage the formations together and axially couple the shaft to the sleeve and therethrough to the clamp housing;

a piston in the clamp housing defining therein a pressurizable compartment, whereby pressurization of the compartment urges the piston axially back in the clamp housing;

at least one axially compressible spring washer engaged axially between the housing and the piston and urging the piston axially forward in the clamp housing; and force-transmitting link means engaged between the piston and the sleeve for compressing the sleeve radially inward on displacement of the piston axially forward.

* * * * *